United States Patent [19]

Lopez et al.

[11] Patent Number: 4,970,190

[45] Date of Patent: Nov. 13, 1990

[54] HEAVY OIL HYDROPROCESSING WITH GROUP VI METAL SLURRY CATALYST

[75] Inventors: Jaime Lopez, Benicia, Calif.; Eugene A. Pasek, Export, Pa.

[73] Assignee: Chevron Research Company, San Francisco, Calif.

[21] Appl. No.: 388,790

[22] Filed: Sep. 5, 1989

Related U.S. Application Data

[60] Division of Ser. No. 941,456, Dec. 15, 1986, Pat. No. 4,857,496, which is a continuation of Ser. No. 767,767, Aug. 21, 1985, abandoned, which is a continuation-in-part of Ser. No. 527,414, Aug. 29, 1983, Pat. No. 4,557,821.

[51] Int. Cl.[5] ..... B01J 27/051

[52] U.S. Cl. ..... 502/220; 502/219; 208/108; 208/143; 208/215

[58] Field of Search ..... 208/108, 112, 215, 143; 502/219, 220

[56] References Cited

U.S. PATENT DOCUMENTS

| | | | |
|---|---|---|---|
| 4,226,742 | 10/1980 | Bearden | 502/220 |
| 4,243,544 | 1/1981 | Naumann et al. | 502/220 |
| 4,431,747 | 2/1984 | Seiver et al. | 502/220 |
| 4,544,481 | 10/1985 | Seiver et al. | 208/215 |
| 4,557,821 | 12/1985 | Lopez et al. | 208/108 |
| 4,557,822 | 12/1985 | Bearden, Jr. et al. | 208/108 |
| 4,579,838 | 4/1986 | Bearden et al. | 502/219 |
| 4,710,486 | 12/1987 | Lopez et al. | 208/108 |
| 4,857,496 | 8/1989 | Lopez et al. | 208/215 |
| 4,863,887 | 9/1989 | Ohtake et al. | 258/112 |

*Primary Examiner*—Anthony McFarlane

[57] ABSTRACT

A process for the preparation of a dispersed Group VIB metal sulfide hydrocarbon oil hydroprocessing catalyst comprising reacting aqueous ammonia and a Group VIB metal compound, such as molybdenum oxide or tungsten oxide, to form water soluble compounds such as aqueous ammonium molybdates or tungstates. The aqueous ammonium molybdates or tungstates are sulfided at a relatively low temperature with hydrogen sulfide without feed oil. The slurry stream is then passed through a separator and ammonia is flashed and separated from the system, leaving a separator residue slurry. The separator residue slurry is then mixed with feed oil, hydrogen and hydrogen sulfide and sulfided at a relatively high temperature to produce a dispersed molybdenum sulfide or tungsten sulfide catalyst of high hydroprocessing activity. The catalyst slurry and feed oil can then be passed to a hydroprocessing reactor.

17 Claims, 1 Drawing Sheet

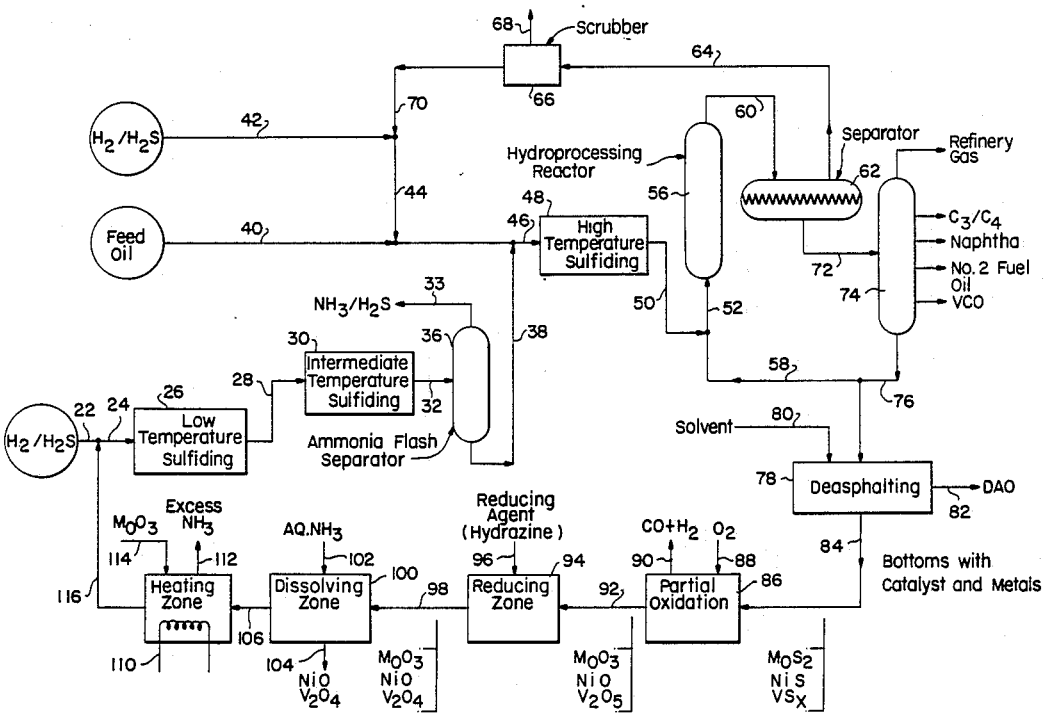

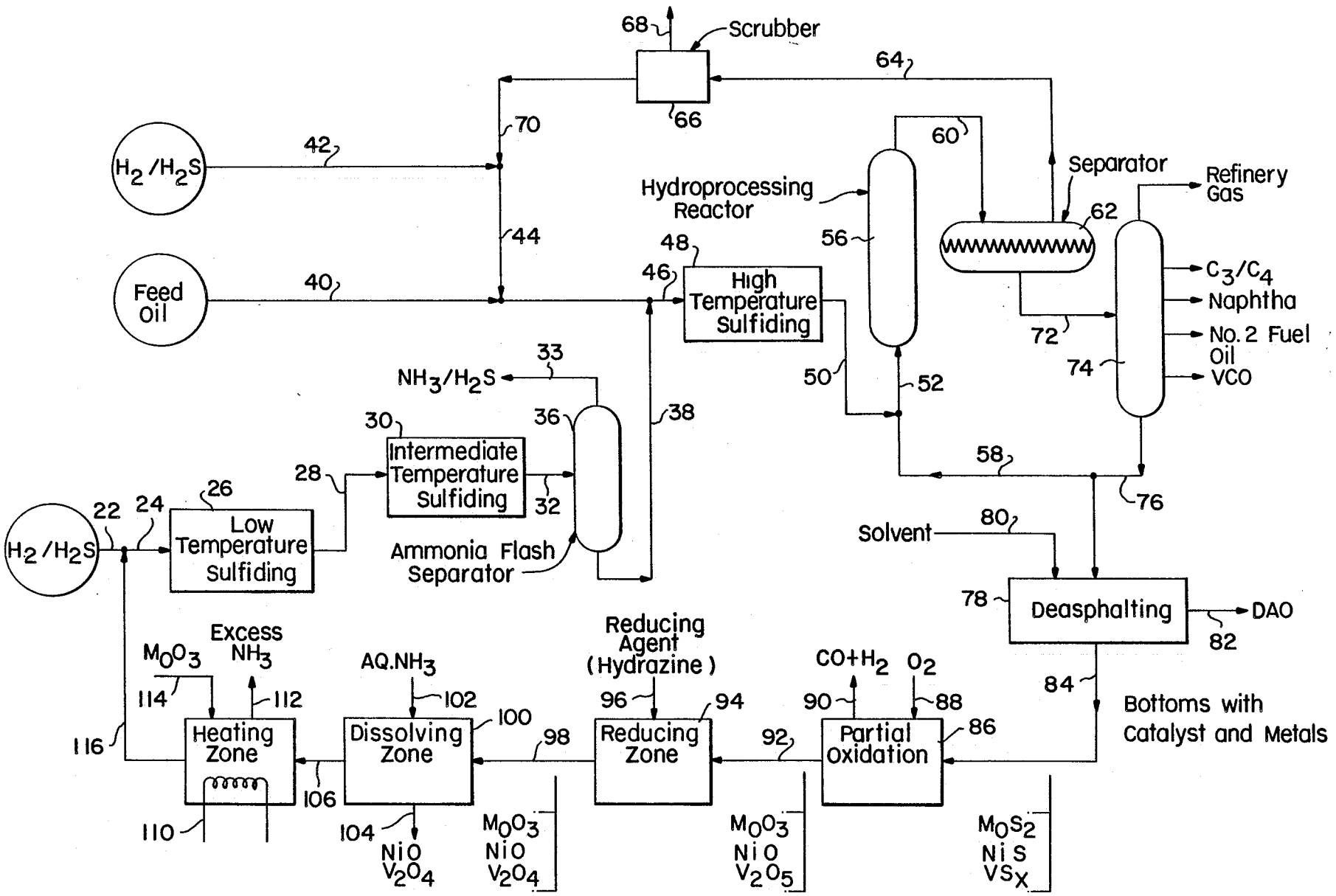
Refinery Gas
$C_3/C_4$
Naphtha
No. 2 Fuel Oil
VCO
Separator
DAO
Bottoms with Catalyst and Metals
Deasphalting
Solvent
Scrubber
Hydroprocessing Reactor
High Temperature Sulfiding
Partial Oxidation
$O_2$
$CO+H_2$
$MoS_2$
Ni S
$VS_X$
$MoO_3$
NiO
$V_2O_5$
Reducing Agent (Hydrazine)
Reducing Zone
$NH_3/H_2S$
Intermediate Temperature Sulfiding
Ammonia Flash Separator
$MoO_3$
NiO
$V_2O_4$
AQ.$NH_3$
Dissolving Zone
NiO
$V_2O_4$
Excess $NH_3$
Heating Zone
$MoO_3$
Low Temperature Sulfiding
$H_2/H_2S$
Feed Oil
$H_2/H_2S$

HEAVY OIL HYDROPROCESSING WITH GROUP VI METAL SLURRY CATALYST

This application is a division of application Ser. No. 941,456, filed Dec. 15, 1986, now U.S. Pat. No. 4,857,496; which in turn is a continuation of application Ser. No. 767,767, filed Aug. 21, 1985 (now abandoned); which was a continuation-in-part of application Ser. No. 527,414, filed Aug. 29, 1983, now U.S. Pat. Pat. No. 4,557,821.

BRIEF DESCRIPTION OF THE DRAWING

The FIGURE is a schematic representation of the process.

DETAILED DESCRIPTION OF THE DRAWING AND PREFERRED EMBODIMENTS

This invention relates to the catalytic hydroprocessing of heavy hydrocarbon oils including crude oils, heavy crude oils and residual oils as well as refractory heavy distillates, including FCC decanted oils and lubricating oils. It also relates to the hydroprocessing of shale oils, oils from tar sands, and coal liquids.

The present invention also relates to the preparation of a slurry hydrogenation catalyst for said catalytic hydroprocessing of hydrocarbon oils.

The catalyst of the present invention is an unsupported circulating sulfided Group VIB metal slurry catalyst, specifically a molybdenum sulfide or tungsten sulfide catalyst. The circulating nature of the slurry catalyst of this invention is conducive to the employment of elevated process temperatures. In contrast, elevated temperatures would be impractical in a fixed bed system. The employment of high process temperatures in conjunction with a fixed bed catalyst induces progressive coke accumulation on the catalyst leading to a catalyst aging problem. In contrast, with a slurry catalyst, catalyst rejuvenation can be very rapid since fresh catalyst can be continuously introduced to the system while used catalyst can be continuously regenerated or removed from the system so that there is no catalyst aging problem.

The particles of the slurry catalyst of this invention exist as a substantially homogeneous dispersion first in water, then in an oil or water/oil mixture of extremely small particles made up of very small crystallites. The activity of the catalyst is dependent in significant part on the smallness of particle size because much of the activity probably is at the exterior of the catalyst. The catalyst is approximately Group VIB metal disulfide which is probably structured molecularly as basal platelets of Group VIB metal atoms separated by two layers of sulfur atoms with activity sites concentrated at the edge of each basal plane of Group VIB metal atoms. However, the ratio of sulfur to Group VIB metal is not necessarily two.

The catalyst of the present invention comprises dispersed particles of a highly active form of a Group VIB metal sulfide, such as molybdenum sulfide or tungsten sulfide. To prepare the catalyst, an aqueous slurry of water-insoluble molybdenum oxide ($MoO_3$) or tungsten oxide ($WO_3$) is reacted with aqueous ammonia to dissolve the molybdenum or tungsten as ammonium molybdates or ammonium tungstates, which are soluble in water. The ammonium molybdates or ammonium tungstates are then sulfided with a sulfiding agent in a plurality of zones or steps of increasing temperature. The initial sulfiding step or steps occur in the aqueous phase in the substantial absence of feed oil. After adequate sulfiding in the aqueous phase, the slurry is mixed with feed oil to form a water/oil system and sulfiding is continued in one or more sulfiding steps. Ammonia is separated from the system after the final aqueous phase sulfiding step and before addition of feed oil.

Molybdenum sulfide is the preferred Group VIB metal sulfide. The final catalyst can comprise crystallites of $MoS_2$, although the atomic ratio of sulfur to molybdenum is frequently not 2 or is only approximately 2. If the catalyst is $MoS_2$, it is an exceptionally active form of $MoS_2$ and is more active catalytically than $MoS_2$ of the prior art. It appears that the activity of the final catalyst depends upon the conditions employed during its preparation. Ser. No. 527,414, filed Aug. 29, 1983, which is hereby incorporated by reference, taught the presence of feed oil during multistage sulfiding of the precursor ammonium salt to $MoS_2$ and did not teach ammonia removal during catalyst preparation. We have now discovered that a significant improvement in catalyst activity is achieved by performing a significant portion of the multistage sulfiding of the precursor ammonium salt in an aqueous phase in the substantial absence of any hydrocarbon oil phase and by separating ammonia from the system in advance of adding an oil phase and continued sulfiding.

The catalyst can be prepared by dissolving a molybdenum compound, such as $MoO_3$, in aqueous ammonia to form ammonium molybdates, with or without the subsequent injection of hydrogen sulfide to the dissolving stage. The ammonium molybdates are soluble in the aqueous medium but the addition of hydrogen sulfide causes some dissolved molybdenum to separate as ammonium molybdenum oxysulfide solids.

According to the prior application, hydrogen sulfide is added to the dissolving stage and the aqueous ammonium molybdenum oxysulfide is mixed with all or a portion of the feed oil stream using the dispersal power of a hydrogen-hydrogen sulfide stream and the admixture is passed through a plurality of heating zones or steps. The heating steps can be three in number, to provide three time-temperature sequences which are necessary to complete the preparation of the final catalyst prior to flowing to the higher temperature exothermic hydroprocessing reactor zone. Each sulfiding zone or step is operated at a temperature higher than its predecessor.

In one embodiment of the present invention, the first sulfiding stage is operated at a relatively low temperature with an aqueous phase and without feed oil. The second sulfiding stage is operated at an intermediate temperature which is higher than the temperature of the low temperature stage and with an aqueous phase substantially in the absence of feed oil. The third stage is operated at a temperature which is higher than the temperature of the intermediate temperature stage. Ammonia is separated from the aqueous stream flowing from the intermediate temperature reactor, leaving a separator residue. The separator residue is passed to the high temperature stage together with added feed oil.

In another embodiment, the first sulfiding stage is operated at a relatively low temperature with an aqueous phase and without feed oil. Ammonia is separated from the aqueous stream flowing from the low temperature sulfiding stage, leaving a separator residue. Feed oil is added to the separator residue and the feed oil/water mixture is passed through intermediate and high temperature sulfiding stages without further removal of ammonia. Each sulfiding stage is operated at a higher temperature than the temperature in its predecessor stage.

Therefore, this invention applies to a process wherein at least three sulfiding stages are employed and oil is first added to either the intermediate temperature sufiding stage or the high temperature sulfiding stage. If oil is first added to the intermediate temperature sulfiding stage, ammonia is vented after the low temperature sulfiding stage. If oil is first added to the high temperature sulfiding stage, ammonia is vented after the intermediate temperature sulfiding stage.

Because the precursor catalyst supplied to the low temperature sulfiding stage comprises an oxygen-containing water soluble ammonium salt of molybdenum or tungsten, such as ammonium molybdates or ammonium tungstates, the sulfiding reactions in the lower temperature sulfiding stages generate ammonia from gradual decomposition of ammonium molybdates or ammonium tungstates. Prior to substantial addition to feed oil, this ammonia, together with any excess ammonia present from the earlier reaction of ammonia with molybdenum oxide or tungsten oxide, is flashed in the separator zone and separated from slurry-containing separator residue in advance of the high temperature sulfiding stage.

The ammonia removal step has a favorable effect upon catalyst activity because ammonia is a depressant to the activity of a hydrogenation catalyst. Ammonia is easily separable from the substantially oil-free aqueous phase effluent from the low and intermediate temperature sulfiding stages of the present invention by cooling and depressurizing the slurry stream. In contrast, the presence of an oil phase (as in the low and intermediate temperature sulfiding zones of Serial No. 527,414) would make ammonia removal considerably more difficult because ammonia is considerably more difficult to separate from an oil/water system than from a water phase.

Ammonia removal is beneficial to catalyst activity because excess ammonia will tend to neutralize the relatively small amount of acid sites of the catalyst-hydrogen sulfide system and remove any small amount of cracking and denitrogenation activity that may be present. But primarily, the ammonia will be adsorbed at metal sites and constitute a catalyst poison. In the absence of oil, the ammonia can be flashed at a lower temperature than with oil, because oil will dissolve the ammonia. If oil were present, the stream would have to be heated prior to depressurization and ammonia vaporization. A simple aqueous phase ammonia flashing step would become a highly expensive flashing operation with an oil phase present.

Another advantage of the present invention is that it permits the process to employ as a feed oil a hot refractory oil stream flowing from an adjacent refinery at an elevated temperature without necessitating a cooling step. For example, a vacuum tower bottoms stream may be available from a refinery at a temperature of about 550° F. Since this temperature is below the temperature of the relatively high temperature sulfiding zone of the present invention, the stream can be directly charged thereto without prior cooling. However, since this temperature is above the temperature of the relatively low temperature sulfiding zone and is also likely to be above the temperature of the intermediate temperature sulfiding zone, if this hot oil stream were to be charged to either of those zones (as would be required by the method of Ser. No. 527,414) it would first have to be cooled.

When ammonia is separated from the aqueous non-oleaginous effluent stream from either the low or the intermediate temperature sulfiding reactor, the effluent stream is cooled, depressurized and passed to a separator zone to allow ammonia to be flashed off together with unreacted, hydrogen sulfide and hydrogen. Ammonia can be scrubbed from the flashed gases and removed from or reused in the system. The ammonia scrubbed hydrogen and hydrogen sulfide can be recycled. Flash residue from the aqueous effluent stream is mixed with feed oil for the first time and is passed together with hydrogen sulfide and hydrogen to the intermediate or high temperature sulfiding reactor, whichever is next in turn, and which is maintained at a temperature above the temperature in the sulfiding reactor intermediately prior to the ammonia flash step. A water-oil slurry containing dispersed molybdenum sulfide slurry catalyst is ultimately produced in the high temperature sulfiding reactor.

If the temperature in the high temperature sulfiding reactor is sufficiently high for hydroprocessing the feed oil, the residence time in the high temperature sulfiding reactor can be sufficient to accomplish both the high temperature sulfiding and the required hydroprocessing reactions. If a higher temperature is required to accomplish hydroprocessing of the feed oil, the effluent stream from the high temperature sulfiding reactor is passed to a hydroprocessing reactor operated at a hydroprocessing temperature which is higher than the temperature in the high temperature sulfiding reactor.

Although not to be bound by any theory, it is believed that the following reactions occur in the various catalyst preparation steps. In the first catalyst preparation step, insoluble, crystalline $MoO_3$ is mixed with water to form a non-oleaginous slurry which is reacted with ammonia to form soluble ammonium molybdates. As an example consider the following generalized equation for the formulation of ammonium heptamolybdate:

$$\underset{\text{Insoluble Crystalline}}{7MoO_3} + 6NH_3 + 3H_2O \longrightarrow \underset{\text{Soluble}}{(NH_4)_6Mo_7O_{24}}$$

The $MoO_3$ is dissolved under the following conditions:

| | |
|---|---|
| $NH_3$/Mo Weight Ratio | 0.1 to 0.6; preferably 0.15 to 0.3 |
| Temperature, °F. | 33 to 350; preferably 120 to 180 |
| Pressure: psig | 0 to 400; preferably 0 to 10 |

The pressure and temperature are not critical. Increased pressure is required to maintain the ammonia in aqueous solution at elevated temperatures. Elevated temperature is necessary to insure reaction and vary the concentration of molybdenum dissolved in the solution. The same conditions can be employed for dissolving $WO_3$, with the exception of the ammonia/tungsten weight ratio; these are 0.03 to 0.31, preferably 0.05 to 0.25.

The solution of ammonium molybdates is passed to a series of sulfiding reactors operated at progressively ascending temperatures. It is first passed to a relatively low temperature sulfiding reactor where it is contacted with gaseous hydrogen sulfide, preferably a hydrogen/- hydrogen sulfide blend, in a non-oleaginous environment. The generalized sulfiding reaction is as follows:

$$(NH_4)_6Mo_7O_{24} + H_2S \longrightarrow \underset{\text{amorphous}}{(NH_4)_xMoO_ySz}$$

The above is a generalized equation when the starting material is ammonium heptamolybdate. The reaction products in the low temperature reactor include ammonium molybdates, ammonium molybdenum oxysulfides and possibly molybdenum sulfides.

Following are the conditions in the low temperature sulfiding reactor:

| | |
|---|---|
| $H_2S$:SCF/Mo:lbs Ratio | above 2.7; preferably above 12 |
| Temperature, °F. | 70 to 350; preferably 130 to 180 |
| Hydrogen sulfide partial pressure, psi | 3 to 400; preferably 150 to 250 |

It is important not to exceed the above temperature range in the low temperature reactor. At temperatures above 350° F. ammonia loss from the catalyst precursor will occur faster than thiosubstitution can proceed and the molybdenum compound which is formed, a lower ammonium entity, will precipitate and possibly plug the reactor.

It is possible to operate the low temperature sulfiding reactor at a temperature below 325° or 350° F. for a relatively long duration to allow the thiosubstitution reaction to proceed faster than ammonia loss so that the molybdenum compound will not precipitate. If the duration in the low temperature sulfiding reaction is sufficiently long, the intermediate temperature sulfiding reactor, described below, can be omitted and the effluent from the low temperature sulfiding reactor can be passed through an ammonia separator and then directly to a high temperature sulfiding reactor.

The effluent stream from the low temperature reactor is preferably transferred to an intermediate temperature reactor, which is aqueous and can be substantially non-oleaginous, operated under the following conditions:

| | |
|---|---|
| Temperature, °F. | 180 to 700; preferably 300 to 550 |
| Hydrogen sulfide Partial pressure, psi | 3 to 440; preferably 150 to 250 |

The temperature in the intermediate temperature sulfiding reactor is preferably higher than temperature in the low temperature sulfiding reactor. If it is desired to employ the same temperature in both reactors, the intermediate temperature reactor can be dispensed with and the low temperature reactor can be operated for a longer time. The time required will be sufficient to accomplish sulfiding of the molybdenum compound and dispersion of the sulfided particles before ammonia loss can occur with precipitation of an molybdenum compound.

The following generalized reaction may occur in the intermediate temperature reactor:

$$(NH_4)_xMoO_ySz + H_2S \rightarrow MoO_{x'}S_{y'} + NH_3$$

where
x' is about 1
y' is about 2

The molybdenum compound in the intermediate temperature reactor is sufficiently sulfided so that upon loss of ammonia it is in a particulate form which is sufficiently fine that it can remain dispersed with sufficient agitation. In addition, the molybdenum compound is sufficiently sulfided that a crystalline structure is evolving from the amorphous form it exhibited in the low temperature sulfiding reactor.

The reaction in the intermediate temperature reactor generates ammonia from the ammonium molybdenum oxysulfide compound. Unless removed, the ammonia will tend to inhibit the activity of the molybdenum catalyst in a subsequent hydrocarbon oil hydroprocessing reactor.

The effluents from both the low and the intermediate temperature reactors comprise a finely dispersed aqueous slurry catalyst precursor together with ammonia, hydrogen and hydrogen sulfide. Either of these slurries can be cooled and depressurized to separate and remove ammonia and, incidently, hydrogen and hydrogen sulfide. Flash conditions, including temperature and pressure, are selected so that most of the ammonia derived from the decomposition of the ammonium molybdenum oxysulfides and any excess ammonia used in forming ammonium molybdate during the dissolution of molybdenum oxide can be removed from the system. It is important that flash conditions are controlled so as to maximize removal of ammonia while retarding water vaporization and loss. Adequate water retention is required to sustain the catalyst as a slurry which is sufficiently fluid to permit pumping and to accomplish dispersion of the catalyst in the feed oil which is added later.

The ammonia is released from the slurry prior to admixing the slurry with feed oil. Because ammonia is significantly more difficult to remove from oil than from water, feed oil is admixed with the catalyst slurry for the first time after the ammonia is separated from the catalyst slurry. Hydrogen sulfide and hydrogen are also introduced to the slurry together with the feed oil. When oil is added, the molybdenum compound is no longer an ammonium salt, but rather is dispersed molybdenum oxysulfide. The molybdenum compound requires further conversion to the molybdenum sulfide active catalyst state in the presence of oil and at a temperature in the range 500° to 750° F., generally, or in the range of 550° to 725° F., preferably, which is above the temperature of the intermediate temperature sulfiding reactor. This further reaction occurs in a high temperature sulfiding reactor in the presence of an oil/water phase and may be expressed by the following generalized reaction:

$$MoO_xS_y \xrightarrow{H_2/H_2S} \underset{\text{Highly Active}}{MoS_2} + H_2O$$

where
x is about 1
y is about 2

The high temperature reactor operated at a temperature in the range 500° to 750° F. can also be employed as the hydroprocessing reactor if the feed oil is capable of being hydroprocessed at a temperature of 750° F., or below. However, feed oils commonly require hydroprocessing temperatures above 750° F., e.g. above 800° F. or at least at a temperature above the temperature in the high temperature sulfiding reactor. In general, the temperature in the hydroprocessing reactor is 650° to 950° F. If such high hydroprocessing temperatures are required, it is important to employ as separate zones a high temperature sulfiding reactor and a hydroprocessing reactor. We have found that if the catalyst precursor leaving the intermediate temperature reactor is passed together with feed oil and hydrogen sulfide directly to a hydroprocessing reactor operated at a temperature above the temperature of the high temperature sulfiding reactor, such as 800° F., or above, in the presence of water, the molybdenum compound loses, rather than gains, sulfur to form an inactive catalyst according to the following reaction:

$$MoO_xS_y + H_2O \xrightarrow{800^\circ F.} \underset{\text{Inactive Catalyst}}{MoO_{x'}S_{y'} + H_2S} \text{ or } \underset{\text{Mixtures}}{(MoO_2/MoS_2 + H_2S)}$$

where y' is less than 2. This mixture is not a sufficiently active catalyst to inhibit coking reactions. It is noted that the $MoO_xS_y$ (where x is about 1, y is about 2) in the presence of hydrogen sulfide and water reacts preferentially with the hydrogen sulfide to become sulfided at a temperature between 500° to 750° F. It has been found that the $MoS_2$ catalyst formed in the temperature range 500° to 750° F. is a low coking catalyst. However, at a temperature above this range, the $MoO_xS_y$ (where x is about 1 and y is about 2) in the presence of hydrogen sulfide and water reacts to form $MoO_{x'}S_{y'}$ (where y' is less than 2), which is inactive. It is noted that the $MoO_xS_y$ (where x is about 1, y is about 2) in the presence of hydrogen sulfide, hydrogen and water reacts with the hydrogen sulfide to become sulfided at a temperature between 500° and 750° F. It has been found that the $MoS_2$ catalyst formed in the temperature range 500° to 750° F. is a low coke forming catalyst. However, at a temperature above this range, the $MoO_xS_y$ (where x is about 1, y is about 2) in the presence of hydrogen sulfide, hydrogen, and water reacts to form $MoO_{x'}S_{y'}$ (where y is less than 2), which is inactive.

As indicated above, the high temperature reactor operated at a temperature between 500° and 750° F. can perform as both a catalyst conversion reactor and a feed oil hydroprocessing reactor if the feed oil is capable of being hydroprocessed at a temperature within this range. However, if a higher hydroprocessing temperature is required, the conversion of the catalyst to molybdenum disulfide will have to be completed in a reactor having a temperature within the range 500° to 750° F., after which the slurry can be passed to a higher temperature hydroprocessing reactor.

The residence time in each sulfiding zone can be, for example, 0.02 or 0.05 to 0.5 hours, or more. The various sulfiding steps can have the same or different residence times. For example, the high temperature sulfiding zone can employ a residence time of 2 hours, or more. In general, the residence time in each sulfiding step can be at least 0.02, 0.05, 0.1 or 0.2 hours. The residence time in each step also can be at least 0.3, 0.4 or 0.5 hours. Each sulfiding zone, stage or step is constituted by a time-temperature relationship and any single reactor can constitute one or more sulfiding zones, stages or steps depending upon whether the stream is heated or is at a constant temperature in the reactor and upon the duration of the stream time within a particular temperature range during stream residence in the reactor.

The total pressure in the sulfiding zones and in the hydroprocessing zone can be about 500 to about 5,000 psi.

The catalyst preparation method described above uses $MoO_3$ as a starting material for preparing the catalyst precursor. However, other molybdenum compounds are also useful. For example, thiosubstituted ammonium molybdates, such as ammonium oxythiomolybdate or ammonium thiomolybdate can be employed. Since these materials are produced from $MoO_3$ in the first two catalyst preparation steps described above, i.e. the reaction of $MoO_3$ with ammonia step and the low temperature sulfiding step, these two steps can be by-passed by employing these thiosubstituted compounds as starting materials. Therefore, when these thiosubstituted compounds are used as catalyst precursors a water slurry thereof can be injected with hydrogen sulfide and hydrogen and passed directly to the intermediate temperature sulfiding reactor described above, followed by separation of ammonia and then the high temperature sulfiding reactor and the hydroprocessing reactor, as described above.

It will be appreciated that the low, intermediate and high temperature sulfiding zones, stages or steps described herein can constitute separate reactors, as illustrated, or some or all of these zones, stages or steps can be merged into a single reactor. In terms of concept, each of these sulfiding zones, stages or steps is represented by a residence time-temperature relationship. If the stream is heated through the temperature range indicated above in any sulfiding zone, stage or step for the time indicated above, then the performance of the process requirements to satisfy that zone, stage or step has occurred.

The embodiment of the present invention which relates to a method for the preparation of a dispersed tungsten sulfide hydrocarbon oil hydroprocessing catalyst is essentially analogous to the molybdenum sulfide catalyst preparation method described above. In the first stage, a tungsten salt, such as $WO_3$, is slurried in water and reacted with ammonia to form water soluble ammonium tungstate. The ammonium tungstate is then sulfided in the same sequence in ascending temperature sulfiding reactors with a similar ammonia separation step, as described for the molybdenum catalyst preparation sequence.

In the first stage, the reaction is as follows:

$$\underset{\text{Insoluble}}{WO_3 + NH_3 + H_2O} \longrightarrow \text{Soluble Ammonium Tungstate}$$

The following reaction occurs in the low temperature sulfiding reactor:

$$\text{Soluble Ammonium Tungstate} + H_2S \rightarrow (NH_4)_x WO_yS_z$$

The reaction occurring in the intermediate temperature sulfiding reactor is:

$$(NH_4)_xWO_yS_z + H_2S \rightarrow WO_{x'}S_{y'} + NH_3$$

where x' is about 1 y' is about 2

Finally, the reaction occurring in the high temperature sulfiding reactor is:

$$WO_xS_y \rightarrow WS_2 + H_2O$$

where x is about 1 y is about 2

If desired, the method of the present invention can employ a combination $MoS_2$- $WS_2$ catalyst.

The following examples will illustrate the catalyst preparation method of this invention.

EXAMPLE 1

Molybdenum oxide dissolving step.

1884.1 grams of molybdenum trioxide and 7309.4 grams of distilled water were blended to form an aqueous slurry. To this slurry, 1307.5 grams of ammonium hydroxide solution (23.2% by weight ammonia) was added and mixed.

Processing conditions were as follows:

| | |
|---|---|
| $NH_3$/Mo Ratio Weight | 0.2342 |
| Temperature | 150° F. |
| Pressure | Atmospheric |
| Time | 2.0 hrs. |

Low temperature sulfiding step.

The resulting ammonium molybdate solution was charged to a reactor. A flow of hydrogen sulfide containing gas (92% hydrogen-8% hydrogen sulfide) was introduced. The operating conditions were as follows:

| | |
|---|---|
| Temperature | 150° F. |
| Pressure | 35.0 psig |
| $H_2S$/Molybdenum Ratio | 2.7 scf/# |
| Time | 0.5 hrs. |

At the end of the sulfiding step, the product was cooled and the resulting slurry pumped from the reactor. The resulting catalyst is identified as Catalyst A as in Table I.

EXAMPLE 2

Molybdenum oxide dissolving step.

Same procedure as in Example 1.

Low temperature sulfiding step.

The resulting solution was charged to a reactor and heated to 150° F. The pressure was increased to 2500 psig. A flow of hydrogen sulfide containing gas (92% hydrogen-8% hydrogen sulfide) was introduced. The sulfiding conditions were as follows:

| | |
|---|---|
| Temperature | 150° F. |
| Pressure | 2500 psig |
| $H_2S$/Molybdenum Ratio | 10.5 scf/# |
| Time | 0.5 hrs. |

At the end of the low temperature sulfiding step, the catalyst was cooled, the reactor was depressurized and ammonia was removed. The resulting catalyst is identified as Catalyst B in Table I.

EXAMPLE 3

Molybdenum oxide dissolving step.

Same procedure as in Example 1.

Low temperature sulfiding step.

The resulting solution was charged to a reactor and heated to 150° F. The pressure was increased to 2500 psig. A flow of hydrogen sulfide-containing gas (92% hydrogen-8% hydrogen sulfide) was introduced. The sulfiding conditions were as follows:

| | |
|---|---|
| Temperature | 150° F. |
| Pressure | 2500 psig |
| $H_2S$/Molybdenum Ratio | 10.5 scf/# |
| Time | 0.5 hrs. |

Intermediate temperature sulfiding step.

At the end of the sulfiding step and without depressurizing, the temperature was increased to 450° F. and maintained at this temperature for 0.5 hours.

When the intermediate temperature sulfiding step was completed, the hydrogen/hydrogen sulfide flow was reduced and the reactor depressurized to 750 psig to remove ammonia while maintaining the same temperature. These conditions were maintained for 0.5 hours. At the end of this stripping step, the reactor was cooled down and the unit totally depressurized to remove ammonia. The resulting catalyst is identified as Catalyst C. No oil was present during any of the steps of Examples 1, 2 and 3.

To test the activity of the catalysts produced in Examples 1, 2 and 3, each catalyst was mixed with feed oil and charged to a rocker bomb operated in a batch mode. The feed oil was an FCC decanted oil. Analytical properties for this oil are shown in Table II. The rocker bomb was then pressurized with a gas blend of 92% hydrogen-8% hydrogen sulfide and was heated to run temperature. Operating conditions were as follows:

| | |
|---|---|
| Temperature | 720° F. |
| Pressure, | |
| Hydrogen | 2200 psi |
| Hydrogen Sulfide | 180 psi |
| Water Vapor | 390 psi |
| Catalyst to Oil Ratio | 0.42 wt Mo/wt Oil |
| Batch Reactor Time | 6 hrs. |

The results of these tests are shown in Table I.

From the results, it is evident that Catalyst C is substantially more active than Catalysts B and A. The greater activity of Catalyst C is indicated by the greater increase in liquid product API gravity, and by the greater decrease in the liquid product sulfur and nitrogen.

EXAMPLE 4

As indicated earlier, the molybdenum oxide dissolving step and the low temperature sulfiding step can be eliminated by charging thiosubstituted ammonium molybdates, such as ammonia oxythiomolybdate, including ammonium oxymonothiomolybdate, ammonium oxydithiomolybdate, ammonium oxytrithimolobydate or ammonium tetrathiomolybdate. To demonstrate this, two thiosubstituted ammonium molybdates, ammonium oxythiomolybdate and ammonium thiomolybdate were prepared.

Ammonium oxydithiomolybdate was prepared according to the procedure described in J. W. Mellor [*Inorganic and Theoretical Chemistry,* page 654 (1959)]. 75 g of ammonium heptamolybdate were added to 225 g of distilled water. To this mixture, 417 cc of ammonium hydroxide solution (28–30% by weight ammonia) was added. The mixture was maintained at a temperature from about 35° F. to about 55° F. The solution was treated with gaseous hydrogen sulfide until a yellow crystalline precipitate formed. The crystals obtained were filtered and washed with cold water, then with ethyl alcohol and finally air dried. These crystals were dispersed in water, in order to maintain a slurry.

This slurry was charged to a Berghof autoclave, pressured to 2300 psig with a hydrogen-hydrogen sulfide gas blend, stirred and heated to 300° F. The heat-up time from room temperature to the final temperature, 300° F. was about 30 minutes. Once at temperature, the total pressure and temperatures were maintained for 30 minutes. The autoclave was cooled and depressurized. The resulting slurry was filtered and the solids redispersed in water. The resultant catalyst is identified in Catalyst D in Table III.

EXAMPLE 5

Ammonium tetrathiomolybdate was prepared by following the procedure described by G. Kruss [*Justus Liebigs Nann Chem.*, 229, 29 (1884)]. 75 g of ammonium heptamolybdate was added to 225 g of distilled water. To this mixture, 417 cc of ammonium hydroxide solution (280–30% by weight ammonia) was added. The mixture was maintained at a temperature from about 33° F. to about 55° F. The solution was treated with gaseous hydrogen sulfide until blood-red crystals deposited. The crystals obtained were filtered and washed with cold water, then ethyl alcohol, and finally air dried. These crystals were dispersed in water.

This slurry was charged to a Berghof autoclave, pressured to 2300 psig with a hydrogen-hydrogen sulfide as blend, stirred and heated to 300° F. The heat-up time from room temperature to the final temperature, 300° F., was about 30 minutes. Once at temperature, the total pressure and temperatures were maintained for 30 minutes. The autoclave heaters were turned off, and the autoclave was depressurized. The resulting slurry was filtered and the solids redispersed in water. This resulting catalyst is identified as Catalyst E in Table III.

Catalysts D and E were tested in the same manner as Catalysts A, B and C. The results are shown in Table III.

The present invention also can be applied to the preparation of dispersed catalysts of Group VI metals other than molybdenum. For example, the method can be applied to the preparation of dispersed tungsten catalysts. A compound of tungsten, such as tungsten oxide, can be dissolved by slurrying with aqueous ammonia. The slurry is treated at the following conditions to form an ammonium tungstate solution:

| | |
|---|---|
| $NH_3$/W Weight Ratio | 0.03 to 0.31; preferably 0.05 to 0.25 |
| Temperature: °F. | 33 to 350; preferably 120 to 180 |
| Pressure: psig | 0 to 400; preferably 0 to 10 |

The pressure and temperature are not critical in themselves. Increased pressure is required to maintain the ammonia in the aqueous solution at elevated temperatures. Elevated temperature is necessary to vary the concentration of tungsten in the catalyst.

The solution of ammonium tungstate(s) is contacted with gaseous hydrogen sulfide, preferably a hydrogen-hydrogen sulfide blend. The mixture is heated in a low temperature sulfiding reactor. The conditions in this reactor are as follows:

| | |
|---|---|
| $H_2S$(SCF):W(lbs) Ratio | greater than 1.4; preferably greater than 6.3 |
| Temperature, °F. | 70 to 350; preferably 130 to 180 |
| Hydrogen Sulfide Partial Pressure: psi | 3 to 400; preferably 150 to 250 |

At these conditions, a mixture comprising ammonium tungstate, ammonium tungsten oxysulfides, and possibly tungsten sulfides is produced.

The low temperature sulfiding reactor mixture is transferred to a second reactor and is heated to a higher temperature. The conditions in this intermediate temperature reactor are as follows:

| | |
|---|---|
| Temperature, °F. | 180 to 700; preferably 300 to 500 |
| Hydrogen Sulfide Partial Pressure: psi | 3 to 400; preferably 150 to 250 |

At the outlet of the intermediate temperature reactor, the product catalyst is a finely dispersed aqueous slurry. Essentially no oil is present in the system at this stage. This slurry product is cooled and depressurized. Flash conditions, temperature and pressure, for the depressurization, are selected such that the bulk of the product ammonia, derived from the decomposition of the ammonium tungsten oxysulfides, and a portion of the water are vaporized. It is critical that flash conditions are controlled so as to maximize removal of ammonia while minimizing water loss so as to retain the catalyst in a slurry to permit pumping and to allow for dispersion of the catalyst in the subsequent oil/hydrogen mixture.

The tungsten dissolving step and the low temperature dissolving step can be eliminated by charging thiosubstituted ammonium tungstates, such as or ammonium thiotungstate or ammonium oxythiotungstate(s) such as ammonium oxymonothiotungstate, ammonium oxydithiotungstate, ammonium oxytrithiotungstate or ammonium oxytetrathiotungstate.

EXAMPLE 6

8.6 g. of ammonium metatungstate (92.5% $WO_3$) (purchased from Sylvania) was dissolved in 53.5 g of distilled water and 2.5 g of ammonium hydroxide (23.2% by weight ammonia).

Processing conditions were as follows:

| | |
|---|---|
| $NH_3$/W Weight Ratio | 0.11 |
| Temperature | Ambient |
| Pressure | Atmospheric |
| Time | 0.5 hrs. |

The resulting solution was introduced to a reactor. A flow of hydrogen sulfide containing gas (92% hydrogen-8% hydrogen sulfide) was introduced. The conditions were as follows:

| | |
|---|---|
| $H_2S$/Tungsten Ratio | 1.4 scf/# |
| Temperature | 150° F. |
| Pressure | 35.0 psig |
| Time | 0.5 hrs. |

At the end of this step, the flow of hydrogen sulfide was stopped, the product cooled; the resulting slurry is identified as Catalyst F in Table IV.

EXAMPLE 7

The solution obtained in the tungsten dissolving step of Example 6 was charged to a Berghof autoclave, pressured to 2300 psig with a hydrogen-hydrogen sulfide gas blend, stirred and heated to 300° F. The heat-up time from room temperature to the final temperature, 300° F., was about 300 minutes. Once at temperature, the total pressure and temperature were maintained for 30 minutes. The autoclave heaters are turned off, and the autoclave is depressurized to vent ammonia. The resultant slurry is identified as Catalyst G in Table IV.

The catalysts produced in Examples 6 and 7 were each mixed with the FCC decanted oil whose properties are shown in Table II and charged to a rocker bomb, operated in a batch mode. The rocker bomb was pressured with a mixture of 92% hydrogen-8% hydrogen sulfide and heated to run temperature. The operating conditions were as follows:

| | |
|---|---|
| Temperature | 720° F. |
| Pressure | |
| Hydrogen | 2200 psi |
| Hydrogen Sulfide | 182 psi |
| Water Vapor | 390 psi |
| Catalyst to Oil Ratio | 0.042 wt W/wt Oil |
| Batch Reactor Time | 6 hrs. |

Table IV shows the results obtained from these runs.

From these data and a comparative analysis, it is apparent that the catalyst, which was pretreated at a higher hydrogen sulfide partial pressure and temperature, Catalyst G, outperformed Catalyst F, both in desulfurization and denitrogenation.

The data given in Table IV show a superiority in respect to API gravity increase, desulfurization and denitrogenation for the water only low temperature sulfiding with an ammonia flashing step according to the method of this invention.

TABLE I

| EXAMPLE: | | #1 | #2 | #3 |
|---|---|---|---|---|
| Catalyst Precursor: | | $MoO_3$ | $MoO_3$ | $MoO_3$ |
| $NH_3$/Mo, Weight Ratio | — | .2342 | .2342 | .2342 |
| Catalyst Treated at: | | | | |
| Conditions: | | | | |
| Step 1. | | | | |
| Temperature: | — | 150° F. | 150° F. | 150° F. |
| $H_2S$ pp, psi | — | 1.5 | 225 | 225 |
| scf/# Mo | — | 2.7 | 10.5 | 10.5 |
| Time | — | 1.0 | 0.5 | 0.5 |
| Step 2. | | | | |
| Temperature, °F. | — | — | — | 450 |
| $H_2S$ pp, psi | — | — | — | 225 |
| scf/# Mo | — | — | — | 10.5 |
| Time | — | — | — | 0.5 |
| Depressurize: | | | | |
| Time | — | — | 0.5 | 0.5 |
| Pressure: | — | — | 750 | 750 |
| Temperature: | | — | 150 | 450 |
| Time: | — | — | 0.5 | 0.5 |
| Screening Conditions: | | | | |
| Pressures: | | | | |
| Hydrogen, psi | 2200 | 2200 | 2200 | 2200 |
| Hydrogen sulfide, psi | 182 | 182 | 182 | 182 |
| Water Vapor, psi | 390 | 390 | 390 | 390 |
| Temperature, °F. | 720 | 720 | 720 | 720 |
| Time at Temperature, hrs. | 6 | 6 | 6 | 6 |
| Cat. to Oil Ratio: Mo/Oil, wt/wt | — | 0.042 | 0.042 | 0.042 |
| CATALYST | NONE | A | B | C |
| Liquid Product Quality: | | | | |
| API | 8.1 | 13.0 | 14.4 | 17.4 |
| Sulfur, wt % | 0.89 | 0.50 | 0.44 | 0.16 |
| Nitrogen, ppm | 760. | 116 | 62 | 18 |
| Performance: | | | | |
| Product Delta API | 3.1 | 8.0 | 9.4 | 12.4 |
| Desulfurization: % | 19.8 | 55.0 | 60.4 | 85.6 |
| Denitrogenation: % | 10.3 | 86.3 | 92.7 | 97.9 |

TABLE II

| FCC Decanted Oil Properties | |
|---|---|
| Gravity: API | 5.0 |
| Carbon: wt % | 89.79 |
| Hydrogen: wt % | 8.37 |
| Sulfur: wt % | 1.11 |
| Nitrogen: wppm | 846. |
| Distillation: °F. | |
| 10% | 662. |
| 30% | 701. |
| 50% | 732. |
| 70% | 781. |
| 90% | 887. |

TABLE III

| EXAMPLE | | #4 | #5 |
|---|---|---|---|
| Catalyst Precursor: | NONE | $(NH_4)_2MoO_2S_2$ | $(NH_4)_2MoS$ |
| $NH_3$/Mo, Weight Ratio | — | 302 | 302 |
| $H_2S$/Mo, scf/# | — | 8 | 16 |
| Solids treated at: | | | |
| $H_2S$ pp, psi | — | 185 | 185 |
| Initial Temperature: | | 70° F. | 70° F. |
| Final Temperature: | | 300° F. | 300° F. |

TABLE III-continued

| EXAMPLE | | #4 | #5 |
|---|---|---|---|
| Time @ Final Temp.: | | 0.5 hrs. | 0.5 hrs. |
| Screening Conditions | | | |
| Pressures: | | | |
| Hydrogen, psi | 2200 | 2200 | 2200 |
| Hydrogen Sulfide, psi | 182 | 182 | 182 |
| Water Vapor, psi | 390 | 390 | 390 |
| Temperature, °F. | 720 | 720 | 720 |
| Time at Temperature, hrs. | 6 | 6 | 6 |
| Cat. to Oil Ratio: | | | |
| Mo/Oil, wt/wt | 0.00 | 0.042 | 0.042 |
| Catalyst | NONE | D | E |
| Oil: | | | |
| API | 8.1 | 14.8 | 14.1 |
| Sulfur, wt % | 0.89 | 0.31 | 0.35 |
| Nitrogen, ppm | 760 | 33 | 45 |
| Performance: | | | |
| Product Delta API | 3.1 | 9.7 | 9.1 |
| Desulfurization: % | 19.8 | 72.1 | 68.5 |
| Denitrogenation: % | 10.3 | 96.1 | 94.7 |

TABLE IV

| EXAMPLE | | #6 | #7 |
|---|---|---|---|
| Catalyst Precursor: | NONE | Ammonium Metatungstate | |
| $NH_3$/W, Weight Ratio | — | .12 | .12 |
| $H_2S$/W: scf/# | — | 1.4 | 1.4 |
| Solids Treated at | | | |
| $H_2S$ pp: psi | — | 1.5 | 225 |
| $H_2$/W: scf/# | — | 1.4 | 10.5 |
| Initial Temperature: °F. | | 70 | 70 |
| Final Temperature: °F. | | 150 | 300 |
| Time @ Final Temp.: hr. | | 1.0 | 0.5 |
| Screening Conditions: | | | |
| Pressures, | | | |
| Hydrogen: psi | 2200 | 2200 | 2200 |
| Hydrogen Sulfide: psi | 182 | 182 | 182 |
| Water Vapor: psi | 390 | 390 | 390 |
| Temperature: °F. | 720 | 720 | 720 |
| Time at Temperature: hrs. | 6 | 6 | 6 |
| Cat. to Oil Ratio, W/Oil: wt/wt | 0.00 | 0.042 | 0.042 |
| Catalyst | None | F | G |
| Feed Oil | | | |
| API 0.5 | 8.1 | 8.4 | 10.1 |
| Sulfur: wt % 1.11 | 0.89 | 0.93 | 0.79 |
| Nitrogen: wppm 846 | 760 | 690 | 590 |
| Performance: | | | |
| Product Delta API | 3.1 | 3.4 | 5.1 |
| Desulfurization: % | 19.8 | 16.2 | 28.8 |
| Denitrogenation: % | 10.3 | 18.5 | 30.3 |

The process of this invention is illustrated in the attached figure wherein catalytic molybdenum or tungsten, in the form of water-insoluble $MoO_3$ or $WO_3$, is introduced through lines 10 and 12 to dissolver zone 14. Recycle molybdenum or tungsten, from a source described below, is introduced through line 16. Water and ammonia are added to dissolver zone 14 through line 18. Water insoluble molybdenum oxide or tungsten oxide is converted to a water soluble ammonium molybdate salt or ammonium tungstate salt in dissolver zone 14.

Aqueous ammonium molybdate or ammonium tungstate containing excess ammonia is discharged from zone 14 through line 20, admixed with hydrogen sulfide entering through line 22 and then passed through line 24 to low temperature sulfiding zone 26. In low temperature sulfiding zone 26, ammonium molybdate or ammonium tungstates are convered to thiosubstituted ammonium molybdates or thiosubstituted ammonium tungstates. In zone 26 the sulfiding temperature is sufficiently low that the ammonium salt is not decomposed while thiosubstitution is beginning. If the ammonium salt were decomposed in the early stages of thiosubstitution, an insoluble oxythiomolybdate on a mixture of $MoO_3/MoS_3$ or an insoluble oxythiotungstate on a mixture of $WO_3$ and $WS_3$ would precipitate out in zone 26 and possibly plug zone 26.

An effluent stream from low temperature sulfiding zone 26 is passed through line 28 to intermediate temperature sulfiding zone 30. Intermediate temperature sulfiding zone 30 is operated at a temperature higher than the temperature in low temperature sulfiding zone 26. The sulfiding reaction is continued in zone 30 and ammonium oxythiomolybdate or ammonium oxythiotungstate is converted to molybdenum oxysulfide or tungsten oxysulfide, thereby freeing ammonia.

An effluent stream from intermediate temperature sulfiding zone 30 is passed through line 32 to ammonia separator or flash chamber 36. In flash separator 36, cooling and depressurizing of the effluent stream from line 32 causes vaporization of ammonia and hydrogen sulfide. Flash conditions are established so that only a minor amount of water is vaporized and sufficent water remains in the flash residue to maintain an easily pumpable slurry suspension of the catalyst.

Flash separator residue is removed from flash separator 36 through lines 37 and 38. The flash residue in line 38 is essentially free of oil since no oil was introduced to low temperature sulfiding zone 26 or intermediate temperature sulfiding zone 30. Feed oil is introduced to the system for the first time through line 40 and is admixed with a hydrogen-hydrogen sulfide mixture entering through lines 42 and 44. The flash residue in line 38 together with feed oil, hydrogen and hydrogen sulfide is introduced through line 46 to high temperature sulfiding zone 48.

High temperature sulfiding zone 48 is operated at a temperature higher than the temperature in intermediate temperature sulfiding zone 30. In high temperature sulfiding zone 48, molybdenum oxysulfide or tungsten oxysulfide is converted to highly active molybdenum disulfide or tungsten disulfide. The preparation of the catalyst is now complete. Some hydroprocessing of the feed oil entering through line 40 is performed in high temperature sulfiding zone 48.

An effluent stream from high temperature sulfiding zone 48 is passed through lines 50 and 52 to hydroprocessing reactor 56. Hydroprocessing reactor is operated at a temperature higher than the temperature in high temperature sulfiding zone 48. If the slurry catalyst bypassed high temperature reactor 48 enroute to hydroprocessing reactor 56, the high temperature of hydroprocessor reactor 56 would cause the water in hydroprocessing reactor 56 to oxygenate the catalyst and therefore compete with sulfiding thereby causing the catalyst to be converted into a sulfur-deficient high coke producer. When high temperature sulfiding zone 48 precedes the hydroprocessing reactor, the relatively lower temperature in zone 48 allows the sulfiding reaction to prevail over any competing oxidation reaction in the presence of water to complete the sulfiding of the catalyst and render it stable at the higher temperature of hydroprocessing zone 56. With certain oil feedstocks, the relatively lower temperature of high temperature sulfiding zone 48 will suffice for performing the oil hydroprocessing reactions, in which case hydroprocessing reactor 56 can be dispensed with. However, most feed oils will require the relatively higher temperature in hydroprocessing reactor 56 to complete the oil hydrotreating reactions.

An effluent stream is removed from hydroprocessing reactor 56 through line 60 and passed to flash separator 62. An overhead gaseous stream is removed from separator 62 through line 64 and is passed through a scrubber 66 wherein impurities such as ammonia and light hydrocarbons are removed and discharged from the system through line 68. A stream of purified hydrogen and hydrogen sulfide is recycled through lines 70, 44 and 46 to high temperature sulfiding reactor 48.

A bottoms oil is removed from separator 62 through line 72 and passed to atmospheric distillation tower 74. As indicated in the figure, various fractions are separated in tower 74 including a refinery gas stream, a $C_3/C_4$ light hydrocarbon stream, a naphtha stream, a No. 2 fuel oil and a vacuum charge oil stream for passage to a vacuum distillation tower, not shown.

A contentrated catalyst slurry stream is removed from the bottom of tower 74 through line 76. Some of this catalyst-containing stream can be recycled to hydroprocessing reactor 56 through line 58, if desired. Most, or all, of the heavy catalytic slurry in line 76 is passed to deasphalting chamber 78 from which a deasphalted oil is removed through line 81. A highly concentrated deactivated catalyst stream is removed from deasphalting chamber 78 through line 80 and passed to catalyst generation zone 82.

The catalyst entering regeneration zone 82 comprises molybdenum sulfide or tungsten sulfide together with coke and impurity metals acquired from the feed oil. The impurity metals comprise primarily vanadium sulfide and nickel sulfide. In regeneration chamber 82 all of these metal sulfides are oxidized by combustion to the oxide state. The metal oxides are then passed through line 84 to catalyst reclamation zone 86. In reclamation zone 86 molybdenum oxide or tungsten oxide is separated from impurity metals including vanadium oxide and nickel oxide by any suitable means. Non-dissolved impurity metals including vanadium and nickel are discharged from the system through line 88 while purified and concentrated molybdenum oxide or tungsten oxide is passed through line 16 for mixing with make-up molybdenum or tungsten oxide entering through line 10, to repeat the cycle.

If desired, the process shown in the figure can be modified by inserting ammonia flash separator 36 in advance of intermediate temperature sulfiding reactor 30. In that case, the hydrogen and hydrogen sulfide mixture in line 42 and the feed oil in line 40 can be charged to intermediate temperature sulfiding reactor 30. The effluent from intermediate temperature sulfiding reactor 30 would be passed directly to high temperature sulfiding reactor 48, without any intermediate separation.

The process in the figure can also be modified by omitting intermediate temperature sulfiding reactor 30. In this modification, the low temperature sulfiding effluent in line 26 is passed directly to line 32 and ammonia flash separator 36.

We claim:

1. A process comprising the preparation of a dispersed Group VIB metal sulfide hydrocarbon oil hydroprocessing catalyst comprising reacting ammonia and a Group VIB metal compound in water to form an aqueous ammonium Group VIB metal compounds, reacting said aqueous ammonium Group VIB metal compounds with hydrogen sulfide essentially in the absence of feed oil in a low temperature sulfiding step at a temperature in the range 70° to 350° F., continuing the reaction of aqueous ammonium Group VIB metal compound with hydrogen sulfide in an intermediate temperature sulfiding step at a temperature in the range 180° to 700° F. which is higher than the temperature in said low temperature sulfiding step and essentially without feed oil, withdrawing an aqueous effluent stream from said intermediate temperature sulfiding step, passing said effluent stream to a separator zone, removing ammonia from said aqueous effluent stream in said separator zone leaving a separator residue, passing said separator residue together with feed hydrocarbon oil and hydrogen sulfide to a high temperature sulfiding step wherein said oil is hydroprocessed at a temperature in the range 500° to 750° F. which is higher than the temperature in said intermediate temperature sulfiding step, the residence time in each of said sulfiding steps being at least 0.02 hours, and withdrawing from said high temperature sulfiding step an aqueous-oil slurry containing dispersed Group VIB metal sulfide slurry catalyst.

2. The process of claim 1 including passing said aqueous oil slurry containing dispersed Group VIB metal sulfide slurry catalyst to a hydroprocessing reactor wherein said hydroprocessing reactor is operated at a temperature which is higher than the temperature in said high temperature sulfiding step.

3. A process comprising the preparation of a dispersed Group VIB metal sulfide hydrocarbon oil hydroprocessing catalyst comprising reacting ammonia and a Group VIB metal compounds in water to form an aqueous ammonium Group VIB metal compounds, reacting said aqueous ammonia Group VIB metal compounds with hydrogen sulfide in a low temperature sulfiding step at a temperature in the range 70° to 350° F. substantially in the absence of feed oil, withdrawing an aqueous effluent stream from said low temperature sulfiding step, passing said aqueous effluent stream to a separator zone, removing ammonia from said effluent stream in said separator zone leaving a separator residue, passing said separator residue together with feed hydrocarbon oil, hydrogen and hydrogen sulfide to a high temperature sulfiding step wherein said oil is hydroprocessed operated at a temperature in the range 500° to 750° F. which is higher than the temperature in said low temperature sulfiding step, the residence time in each of said sulfiding steps being at least 0.02 hours, and withdrawing an aqueous-oil slurry containing dispersed Group VIB metal sulfide slurry catalyst.

4. The process of claim 3 including passing said aqueous-oil slurry containing dispersed Group VIB metal sulfide slurry catalyst to a hydroprocessing reactor wherein said hydroprocessing reactor is operated at a temperature which is higher than the temperature in said high temperature sulfiding step.

5. A process comprising the preparation of a dispersed molybdenum sulfide or tungsten sulfide hydrocarbon oil hydroprocessing catalyst comprising reacting a thiosubstituted ammonium molybdate or ammonium tungstate, water, and hydrogen sulfide substantially in the absence of feed oil in a zone at a relatively low temperature in the range 70° to 350° F., withdrawing an aqueous effluent stream from said relatively low temperature zone, passing said effluent stream to a separator zone, removing ammonia from said aqueous effluent stream in said separator zone leaving a separator residue, passing said separator residue together with feed hydrocarbon oil, hydrogen and hydrogen sulfide to a high temperature sulfiding zone wherein said oil is hydroprocessed at a temperature in the range of 500° to 750° F., the residence time in each of said sulfiding zones being at least 0.02 hours and removing an aqueous-oil slurry containing dispersed Group VIB metal sulfide catalyst.

6. The process of claim 5 including passing said aqueous-oil slurry containing dispersed Group VIB metal sulfide slurry catalyst to a hydroprocessing reactor wherein said hydroprocessing reactor is operated at a temperature in the range of 650° to 950° F. which is higher than the temperature in said high temperature sulfiding zone.

7. A process comprising the preparation of a dispersed molybdenum sulfide hydrocarbon oil hydroprocessing catalyst comprising reacting ammonia and a molybdenum compound in water to form aqueous ammonium molybdates, reacting said aqueous ammonium molybdates with hydrogen sulfide essentially in the absence of feed oil in a low temperature sulfiding step at a temperature in the range of 70° to 350° F., continuing the reaction with hydrogen sulfide in an intermediate temperature sulfiding step at a temperature in the range 180° to 700° F. essentially without feed oil, said intermediate temperature sulfiding step operated at a temperature which is higher than the temperature in said low temperature sulfiding step, withdrawing an aqueous effluent stream from said intermediate temperature sulfiding step, passing said effluent stream to a separator zone, removing ammonia from said aqueous effluent stream in said separator zone leaving a separator residue, passing said separator residue together with feed hydrocarbon oil, hydrogen and hydrogen sulfide to a high temperature sulfiding step at a temperature in the range 500° to 750° F. which is higher than the temperature in said intermediate temperature sulfiding step, the residence time in each of said sulfiding steps being at least 0.02 hours, withdrawing from said high temperature sulfiding step an aqueous-oil slurry containing dispersed molybdenum sulfide slurry catalyst and passing said catalyst to a hydroprocessing step.

8. The process of claim 7 wherein said hydroprocessing step is operated at a temperature higher than the temperature in said high temperature sulfiding step.

9. The process of claim 8 wherein said hydroprocessing step is operated at a temperature in the range of 650° F. to 950° F.

10. A process comprising the preparation of a dispersed molybdenum sulfide hydrocarbon oil hydroprocessing catalyst comprising reacting ammonia and a molybdenum compound in water to form aqueous ammonium molybdate, reacting said aqueous ammonium molybdate with hydrogen sulfide in a low temperature sulfiding step at a temperature in the range 70° to 350° F. substantially in the absence of feed oil, withdrawing an aqueous effluent stream from said low temperature sulfiding step, passing said aqueous effluent stream to a separator zone, separating ammonia from said effluent stream in said separator zone leaving a separator residue, passing said separator residue together with feed hydrocarbon oil, hydrogen and hydrogen sulfide to a high temperature sulfiding step wherein said oil is hydroprocessed at a temperature between 500° and 750° F., the residence time in each of said sulfiding steps being at least 0.02 hours, and withdrawing an aqueous-oil slurry containing dispersed molybdenum sulfide slurry catalyst.

11. The process of claim 10 including passing said aqueous-oil slurry containing dispersed molybdenum sulfide catalyst to a hydroprocessing step wherein said hydroprocessing step is operated at a temperature which is higher than the temperature in said sulfiding step.

12. A process comprising the preparation of a dispersed molybdenum sulfide hydrocarbon oil hydroprocessing catalyst comprising reacting thiosubstituted ammonium molybdate, water, and hydrogen sulfide substantially in the absence of hydrocarbon oil in a relatively low temperature sulfiding step at a temperature in the range 180° to 700° F., withdrawing an aqueous effluent stream from said relatively low temperature sulfiding step, passing said effluent stream to a separator zone, separating ammonia from said aqueous effluent stream in said separator zone leaving a separator residue, passing said separator residue together with feed hydrocarbon oil, hydrogen and hydrogen sulfide to a relatively high temperature sulfiding step at a temperature in the range 500° to 750° F. which is higher than the temperature in said low temperature sulfiding step, the residence time in each of said sulfiding steps being at least 0.02 hours, recovering an aqueous-oil slurry containing dispersed molybdenum sulfide catalyst and passing said catalyst to a hydroprocessing step.

13. The process of claim 12 wherein said hydroprocessing step is operated at a temperature above the temperature of said high temperature sulfiding step.

14. A process comprising the preparation of a dispersed tungsten sulfide hydrocarbon oil hydroprocessing catalyst comprising reacting ammonia and a tungsten compound in water to form aqueous ammonium tungstates, reacting said aqueous ammonium tungstates with hydrogen sulfide in a low temperature sulfiding step at a temperature in the range 70° to 350° F. essentially in the absence of feed oil, continuing the reaction with hydrogen sulfide in an intermediate temperature sulfiding step at a temperature in the range 180° to 700° F. essentially without feed oil, said intermediate temperature sulfiding step operated at a temperature higher than the temperature in said low temperature sulfiding step, withdrawing an aqueous effluent stream from said intermediate temperature sulfiding step, passing said effluent stream to a separator step, separating ammonia from said aqueous effluent stream in said separator zone leaving a separator residue, passing said separator residue together with hydrocarbon oil, hydrogen and hydrogen sulfide to a high temperature sulfiding step operated at a temperature in the range of 500° to 750° F. which is higher than the temperature in said intermediate temperature sulfiding step, the residence time in each of said sulfiding steps being at least 0.02 hours, withdrawing from said high temperature sulfiding step an aqueous-oil slurry containing dispersed tungsten sulfide catalyst and passing said catalyst with feed oil and hydrogen to a hydroprocessing step.

15. The process of claim 14 wherein said hydroprocessing step is operated at a temperature higher than the temperature in said high temperature sulfiding step.

16. A process comprising the preparation of a dispersed tungsten sulfide hydrocarbon oil hydroprocessing catalyst comprising reacting thiosubstituted ammonium tungstate, water and hydrogen sulfide substantially in the absence of feed oil in a sulfiding step at a relatively low temperature in the range 180° to 700° F., withdrawing an aqueous effluent stream from said relatively low temperature sulfiding step, passing said effluent stream to a separator zone, separating ammonia from said aqueous effluent stream in said separator zone leaving a separator residue, passing said separator residue with feed hydrocarbon oil, hydrogen and hydrogen sulfide to a sulfiding step wherein said feed oil is hydroprocessed at a relatively high temperature in the range 500° to 750° F. which is above the temperature in said low temperature sulfiding step, the residence time in each of said sulfiding steps being at least 0.02 hours, and recovering an aqueous-oil slurry containing dispersed tungsten sulfide catalyst.

17. The process of claim 16 including passing said aqueous-oil slurry containing dispersed tungsten sulfide catalyst to a hydroprocessing step wherein said hydroprocessing step is operated at a temperature which is higher than the temperature in said sulfiding step.

* * * * *